US007114199B2

(12) United States Patent
Conway et al.

(10) Patent No.: US 7,114,199 B2
(45) Date of Patent: Oct. 3, 2006

(54) TOILET RIM MOUNTED DEVICE FOR DISPENSING TWO LIQUIDS

(75) Inventors: Simon M. Conway, Burlington, WI (US); Stephen R. Schwallie, Racine, WI (US); David S. Iverson, Chicago, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 301 days.

(21) Appl. No.: 10/824,231

(22) Filed: Apr. 14, 2004

(65) Prior Publication Data

US 2004/0221378 A1 Nov. 11, 2004

Related U.S. Application Data

(60) Provisional application No. 60/465,847, filed on Apr. 25, 2003.

(51) Int. Cl.
*E03D 9/02* (2006.01)

(52) U.S. Cl. ..... 4/231

(58) Field of Classification Search ..... 4/231
See application file for complete search history.

(56) References Cited

U.S. PATENT DOCUMENTS

| | | | |
|---|---|---|---|
| 2,214,798 | A | 9/1940 | Reikowsky |
| 3,529,309 | A | 9/1970 | Leavitt et al. |
| 3,946,448 | A | 3/1976 | Sioufy |
| 4,513,459 | A | 4/1985 | Doughty |
| 4,530,118 | A | 7/1985 | Richards |
| 4,555,819 | A | 12/1985 | Weiss et al. |
| 4,597,941 | A | 7/1986 | Bottom et al. |
| 4,605,534 | A | 8/1986 | Meloy |
| 4,632,350 | A | 12/1986 | Brown |
| 4,668,475 | A | 5/1987 | Meloy |
| 4,709,424 | A | 12/1987 | Dolan |
| 4,729,880 | A | 3/1988 | Dirksing et al. |
| 5,367,716 | A | 11/1994 | Huang |
| 5,377,363 | A | 1/1995 | Shieh |
| 5,774,903 | A | 7/1998 | Wilson et al. |
| 6,003,161 | A | 12/1999 | Tomaini |
| 6,041,449 | A | 3/2000 | Brown et al. |
| 6,178,564 | B1 | 1/2001 | Leonard et al. |
| 6,230,334 | B1 | 5/2001 | Camp et al. |
| 6,389,610 | B1 | 5/2002 | Hautmann et al. |
| 6,412,120 | B1 | 7/2002 | Leonard et al. |
| 6,434,758 | B1 | 8/2002 | Camp et al. |
| 6,505,356 | B1 | 1/2003 | Leonard et al. |

(Continued)

FOREIGN PATENT DOCUMENTS

DE 2947546 A1 6/1981

(Continued)

*Primary Examiner*—Charles E. Phillips

(57) ABSTRACT

A device for dispensing liquids from under the rim of a toilet by way of the toilet flush water is disclosed. The device includes a first arcuate bottle containing a first liquid and a second arcuate bottle containing a second liquid. The dispensing device has an arcuate base for holding the bottles. A wicking device supported by the base conveys liquid from the bottles to dispensing positions contacted with flush water. A hook is provided for suspending the base from a toilet rim. The majority of the upper surfaces of the bottles are not visible from above the rim of the toilet bowl when the dispensing device is installed on the rim, and the wicking device does not extend outward beyond an edge of the base. The bottles are at least partially spaced apart to define a flush water flow path between the bottles and through openings in the base.

14 Claims, 12 Drawing Sheets

U.S. PATENT DOCUMENTS

| | | | | |
|---|---|---|---|---|
| 6,519,783 | B1 | 2/2003 | Falchieri | |
| 6,675,396 | B1 * | 1/2004 | Varanasi et al. | 4/223 |
| 2002/0083514 | A1 | 7/2002 | Lhoste | |
| 2002/0116751 | A1 | 8/2002 | Slade | |
| 2002/0148036 | A1 | 10/2002 | Wilson et al. | |

FOREIGN PATENT DOCUMENTS

| | | | |
|---|---|---|---|
| EP | 0538957 | B1 | 3/1996 |
| EP | 0960984 | A2 | 5/1999 |
| EP | 0785315 | B1 | 6/2000 |
| EP | 1046756 | A1 | 10/2000 |
| GB | 2349157 | A | 10/2000 |
| WO | WO 99/66139 | | 12/1999 |
| WO | WO 99/66140 | | 12/1999 |
| WO | WO 02/40787 | A1 | 5/2002 |
| WO | WO 02/40791 | A1 | 5/2002 |
| WO | WO 02/40792 | A1 | 5/2002 |
| WO | WO 02/064898 | A1 | 8/2002 |

* cited by examiner

FIG. 9A
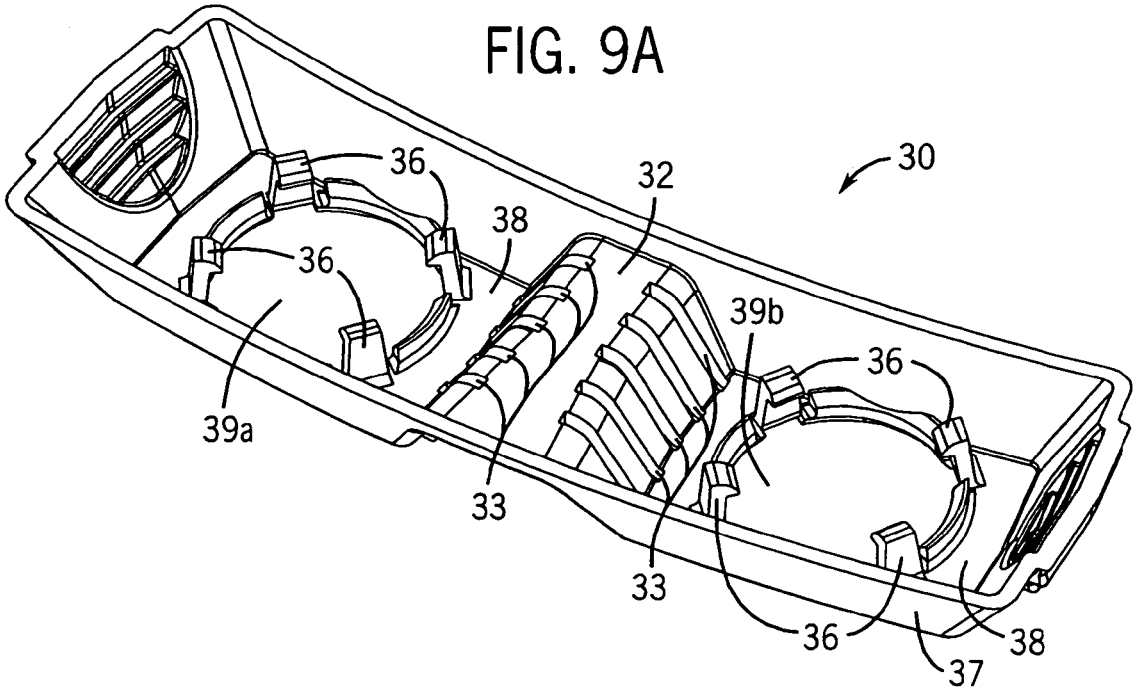
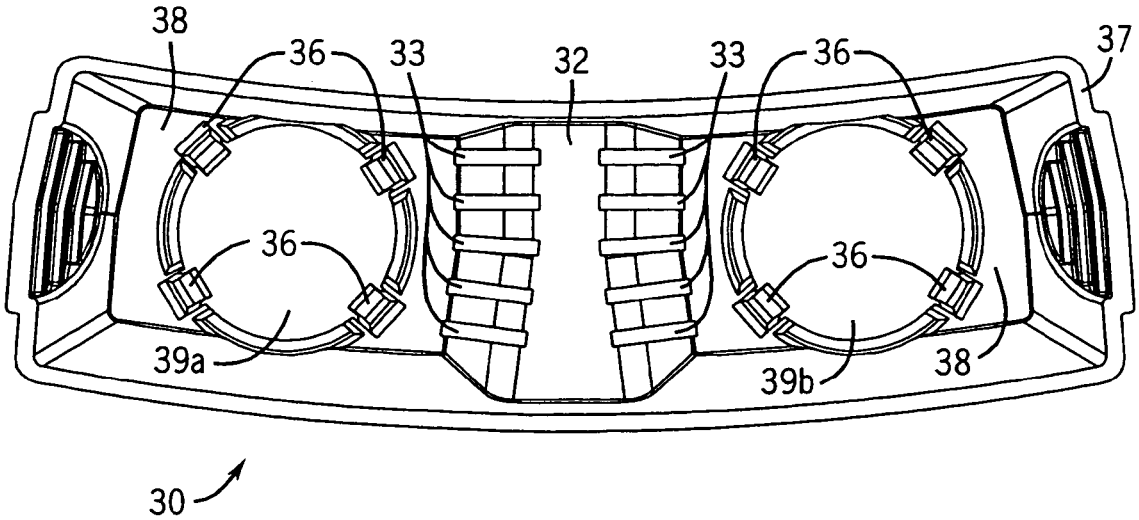
FIG. 9B

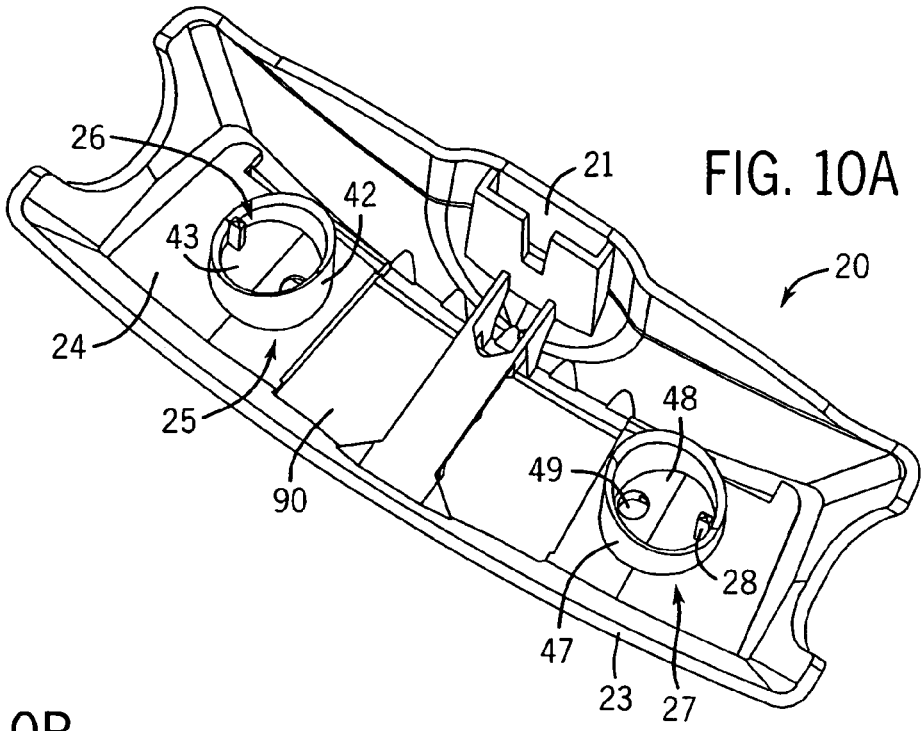
FIG. 10A
FIG. 10B
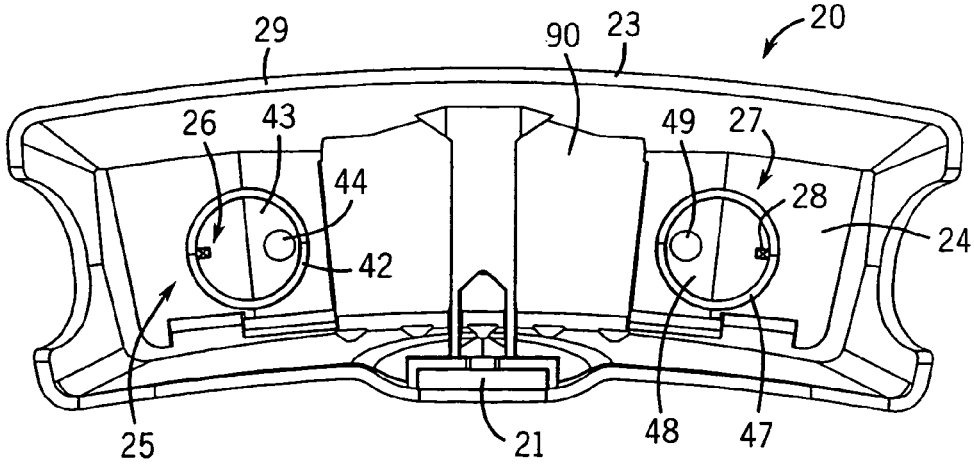
FIG. 10C
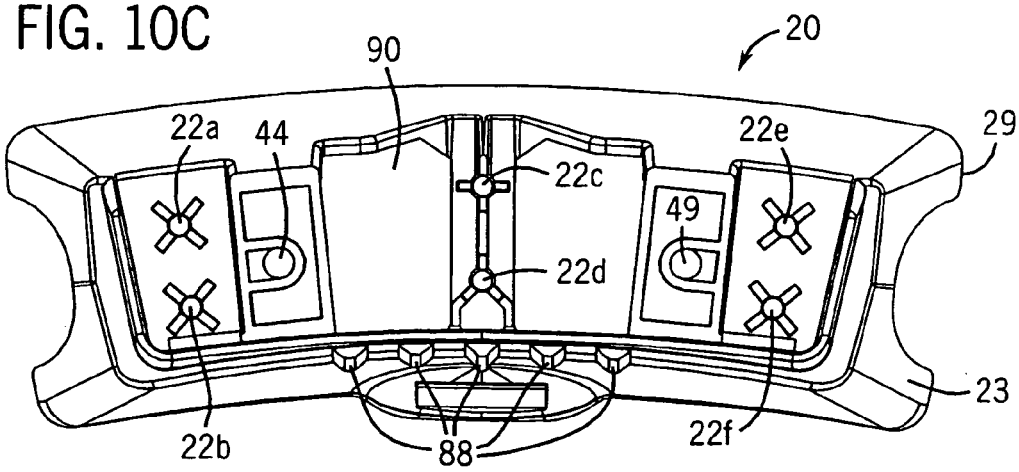

TOILET RIM MOUNTED DEVICE FOR DISPENSING TWO LIQUIDS

CROSS-REFERENCES TO RELATED APPLICATIONS

This application claims the benefit of U.S. Provisional Patent Application No. 60/465,847, filed on Apr. 25, 2003.

STATEMENT REGARDING FEDERALLY SPONSORED RESEARCH

Not Applicable.

BACKGROUND OF THE INVENTION

1. Field of the Invention

This invention relates to liquid dispensers, and in particular to devices for dispensing cleaning and freshening liquids from under the rim of a toilet bowl.

2. Description of the Related Art

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. This task has required manual labor to keep the toilet bowl clean.

In order to eliminate the manual scrubbing, various automatic cleaning toilet bowl cleaning products have been proposed. One type of product comprises a solid block or solid particles of a cleansing and freshening substance that is suspended from the rim of a toilet bowl in a container that is placed in the path of the flushing water. U.S. Pat. Nos. 2,214,798 and 3,529,309 and U.S. patent application Publication Ser. No. U.S. 2002/0083514 show examples of this type of toilet bowl cleaning system. Typically, a portion of the solid block is dissolved in the flush water with each flush, and the flush water having dissolved product is dispensed into the toilet bowl for cleaning the bowl. These solid block toilet cleaning systems have certain disadvantages such as a short lifetime and a decline in the amount of cleaning and deodorizing agents released into the toilet bowl as the solid block deteriorates.

Other automatic toilet bowl cleaning systems use a liquid cleaning agent that is dispensed into a toilet bowl. For example, European Patent Application Nos. EP 0538957 and EP 0785315, U.S. Pat. Nos. 6,178,564, 6,230,334, 6,389,610, 6,412,120, 6,434,758, and 6,519,783, PCT International Publication Nos. WO 99/66139 and WO 99/66140, and U.S. patent application Publication Ser. No. 2002/0116751 all disclose cleansing and/or freshening units capable of being suspended from the rim of a toilet bowl for the purpose of introducing liquid active substances from a bottle into the flushing water with each flush. Typically, the liquid active substances may include one of more of the following: surfactants (such as a mixture of an anionic surfactant and a nonionic surfactant), solvents, sequesterants, pH controllers, thickeners, preservatives, fragrances, and dyes.

While these under the toilet rim liquid dispensing toilet bowl cleaning systems provide an improved alternative to the solid block toilet cleaning systems described above, it may be difficult to incorporate certain toilet bowl cleaning actives, such as bleaches and various hypochlorites, into the liquid active substance. In this regard, bleaches and hypochlorites may affect properties of the components of the liquid active substance. For example, bleaches and hypochlorites will typically fade the color of a dye and destroy a fragrance upon extended contact. Also, certain incompatible cleaning actives may not be stable when mixed and through the resulting chemical interaction, the efficacy of the individual cleaning actives may be decreased. For instance, the efficacy of certain surfactants may be decreased by bleaches and hypochlorites. These limitations in liquid dispensing cleaning systems have prevented the optimization of toilet bowl cleaning active substances in one liquid formulation. In particular, the inability to incorporate bleaches and hypochlorites into a liquid active substance is especially detrimental as bleaches and hypochlorites are particularly effective in destroying bacteria and preventing biofilm formation.

The problems associated with incompatible cleaning actives can be addressed through the use of an automatic under the toilet rim cleaning system having separate compartments for two liquids or for a liquid and a solid. For example, U.S. patent application Publication Ser. No. 2002/0148036A1 (also WO 02/064898A1) discloses a liquid dispensing unit for a toilet bowl that includes a first container containing a first, liquid formulation, a second container containing a second formulation, which may be a solid tablet or a liquid. The liquid from container flows onto a delivery surface from where it is washed into the toilet bowl by the flush water. Some flush water also washes over the second formulation to take components into solution and deliver them into the toilet bowl through an aperture. The constituents of the two formulations are thus kept separate until they enter the toilet bowl. WO 02/40792A1 describes an under the toilet rim dispenser having a reservoir with two liquid compartments and a third compartment for a solid cleansing block. Outlets from the two liquid compartments deliver the liquids to a porous mass where flush water mixes with the liquids and enters the toilet bowl. Flush water also enters the third compartment and dissolves a portion of the solid block before entering the toilet bowl. WO 02/40791A1 and WO 02/40787A1 also describe under the toilet rim dispensers having a reservoir with two liquid compartments.

While these two cleaner automatic under the toilet rim cleaning devices may address the problems associated with incompatible cleaning actives, these devices can be quite bulky and as a result, these devices spoil the look of the toilet. What is needed therefore is an improved toilet rim mounted device for dispensing two separate liquids wherein the device is more completely hidden from view when the device is installed on a toilet rim.

BRIEF SUMMARY OF THE INVENTION

The foregoing needs are met by a dispensing device according to the invention in which flush water during a toilet flush is used to dispense two liquids into a toilet bowl. The dispensing device includes a first bottle for holding a first liquid and a second bottle for holding a second liquid. The first bottle and the second bottle each have a mouth and a closure for covering the mouth. The dispensing device has a base for holding the first bottle and the second bottle. The base has a first piercing post and a second piercing post. The first piercing post is suitable for opening the closure of the first bottle and the second piercing post is suitable for opening the closure of the second bottle. A wicking device is supported by the base. The wicking device is suitable to convey the liquid from the first bottle to a first dispensing position contacted with flush water during a toilet flush, and the wicking device is also suitable to convey the liquid from the second bottle to a second dispensing position contacted with flush water during a toilet flush. A suspension hook is also provided for suspending the base from a rim of the toilet bowl.

In one aspect of the invention, a majority of an upper surface of the first bottle and a majority of an upper surface of the second bottle are not visible from above the rim of the toilet bowl when the dispensing device is installed on the rim of the toilet bowl.

In another aspect of the invention, the wicking device does not extend outward beyond an outermost edge of the base.

In yet another aspect of the invention, the first bottle and the second bottle are at least partially spaced apart to define a flush water flow path between the first bottle and the second bottle and through openings in the base. The openings in the base may direct flush water onto an upper surface of the wicking device.

In still another aspect of the invention, the wicking device comprises a dispensing plate having channels formed in an upper surface of the dispensing plate and the channels include a first group of channels extending inward from a position below the mouth of the first bottle and a second group of channels extending inward from a position below the mouth of the second bottle. The dispensing plate may have an upwardly extending wall positioned between the first group of channels and the second group of channels. In one form, the first group of channels extends inward from a first collecting cavity at the position below the mouth of the first bottle and the second group of channels extends inward from a second collecting cavity at the position below the mouth of the second bottle.

In yet another aspect of the invention, the first bottle and the second bottle are arcuate, and a side wall of the first bottle and a side wall of the second bottle define a convex plane opposite the suspension hook when the first bottle and the second bottle are installed in the base.

In still another aspect of the invention, the base is arcuate, and the base may include a plurality of upstanding tabs for securing the first bottle and the second bottle in the base.

It is therefore an advantage of the present invention to provide an improved device that can dispense quantities of two toilet bowl treatment liquids from under the rim of a toilet bowl during a flush.

It is another advantage of the present invention to provide an under the toilet rim liquid dispensing device that can be installed under the rim of the toilet bowl such that the holder, reservoirs and dispensing plate are substantially hidden when viewed from above and therefore, the liquid dispensing device does not spoil the look of the toilet.

BRIEF DESCRIPTION OF THE DRAWINGS

These and other features, aspects, and advantages of the present invention will become better understood upon consideration of the following detailed description, appended claims, and drawings where:

FIG. 9A is a front right perspective view from above of the upper base element of the liquid dispensing device of FIG. 1;

FIG. 9B is a top view of the upper base element of the liquid dispensing device of FIG. 1;

FIG. 10A is a front right perspective view from above of the lower base element of the liquid dispensing device of FIG. 1;

FIG. 10B is a top view of the lower base element of the liquid dispensing device of FIG. 1;

FIG. 10C is a bottom view of the lower base element of the liquid dispensing device of FIG. 1;

Like reference numerals will be used to refer to like or similar parts from Figure to Figure in the following description of the invention.

DETAILED DESCRIPTION OF THE INVENTION

Figure 12:
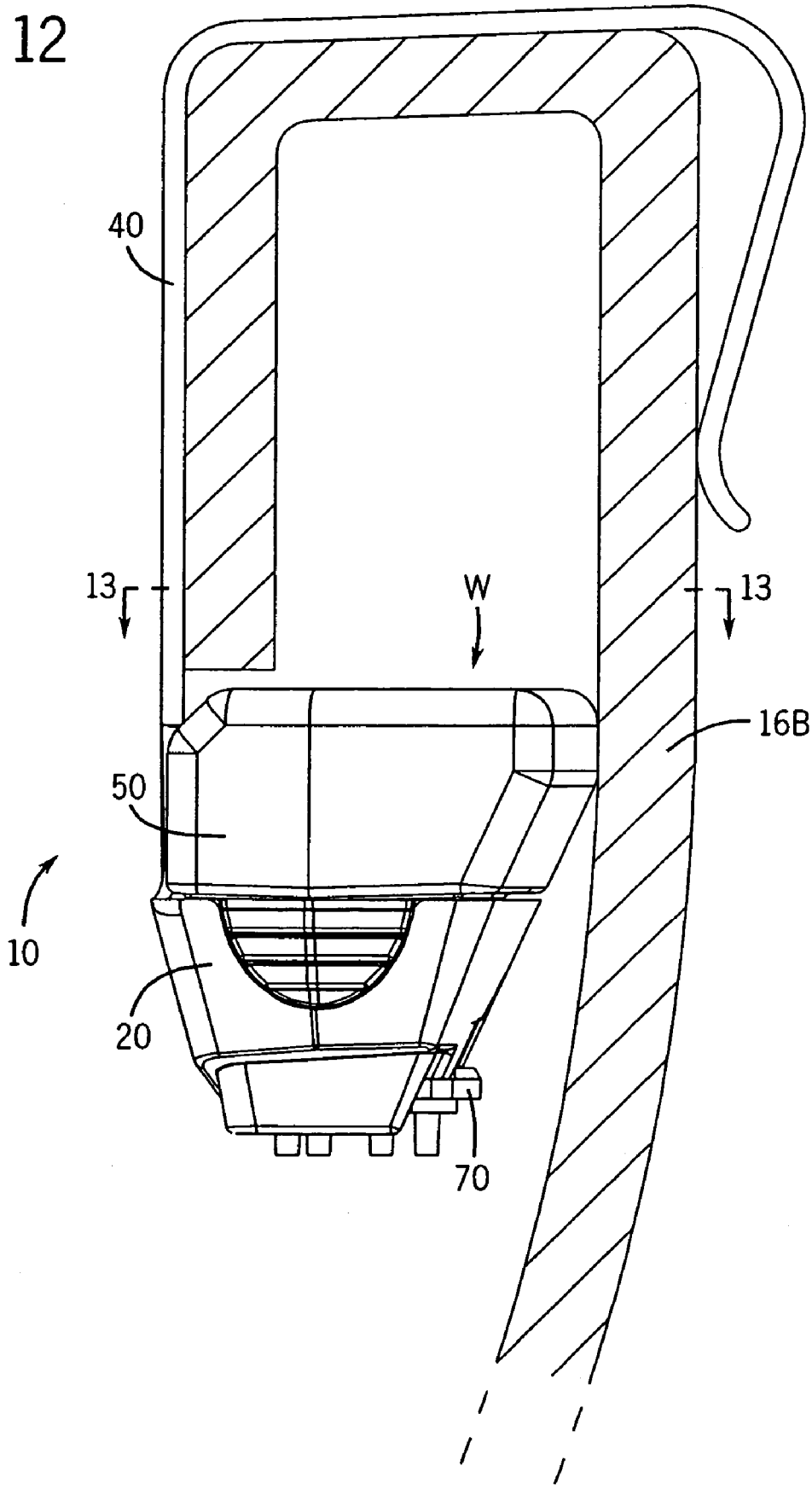
FIG. 12 is a left side view of the liquid dispensing device of FIG. 1 installed on a open rim type toilet.
Figure 13:
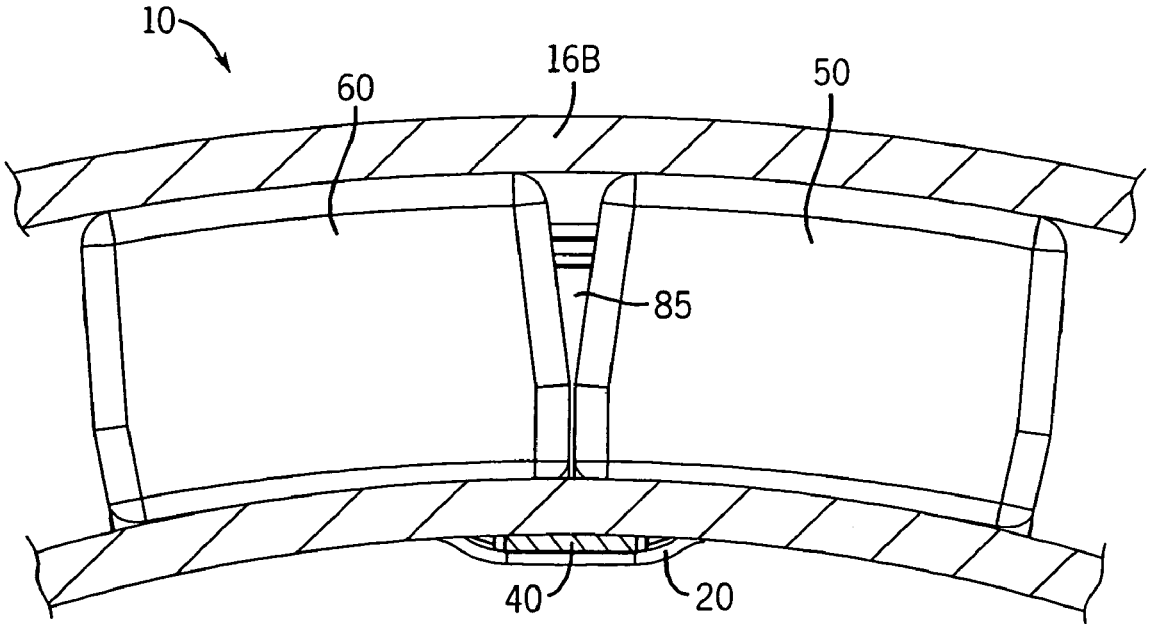
FIG. 13 is view taken along line 13–13 of FIG. 12.

Referring to FIGS. 1 to 11B, there is shown a liquid dispensing device 10 according to the invention for dispensing toilet bowl treatment preparations from the rim of a toilet bowl. The device 10 includes a lower base element 20, an upper base element 30, a sprung suspension hook 40 for suspending the device 10 from the rim of a toilet bowl (as shown in FIGS. 12 and 13), a first bottle 50 having a first closure 54 and containing a first liquid 58, a second bottle 60 having a second closure 64 and containing a second liquid 68, and a dispensing plate 70 that is supported by the lower base element 20.

The first liquid 58 used in the first bottle 58 may be any liquid formula having the cleaning, foaming, disinfecting and fragrancing characteristics required for the specific toilet cleaning application. One example first liquid 58 comprises an anionic surfactant, a nonionic surfactant, a solvent, a sequesterant, a base to control pH, a thickener, a preservative, a fragrance, and a dye. The second liquid 68 used in the second bottle 60 may be any liquid formula having the cleaning, foaming, disinfecting and fragrancing characteristics required for the specific toilet cleaning application. One example second liquid 68 is an aqueous limescale remover including an acid such as acetic, citric or sulfamic acid. Another example second liquid 68 is an aqueous composition including bleaches and/or various hypochlorites.

A user inserts a sealed inverted first bottle 50 into the base structure formed by the lower base element 20 and the upper base element 30 and a sealed inverted second bottle 60 into the base structure formed by the lower base element 20 and the upper base element 30. Each act of insertion causes a seal on the bottle to break, in a manner to be described below. A wicking device, which is in the form of dispensing plate 70 in the preferred embodiment shown but may also be a porous pad, is supported by the lower base element 20. By "wicking device", we mean an element that can transfer a fluid from one location to another location. The dispensing plate 70 conveys the first liquid 58 from the first bottle 50 to a position contacted by flush water by capillary action, and conveys the second liquid 68 from the second bottle 60 to a position contacted by flush water by capillary action.

While a variety of materials may be used to form the lower base element 20, the upper base element 30, the suspension hook 40, the first bottle 50, the second bottle 60 and the dispensing plate 70, it is preferable to manufacture these components from a thermoplastic material such as polyethylene or polypropylene. Typically, the lower base element 20, the upper base element 30, the suspension hook 40 and the dispensing plate 70 comprise an opaque thermoplastic material such as pigmented polyethylene or polypropylene, and the first bottle 50 and the second bottle 60 comprise a transparent thermoplastic material such as clear polyethylene or polypropylene. For ease of manufacture, the suspension hook 40 is formed as a separate component from the lower base element 20, and the lower base element 20 is formed with an integral guide channel 21 into which the lower end of the suspension hook 40 is inserted during assembly such that the hook 40 remains engaged within the channel 21 by a snap-fitting or press-fitting arrangement. Also, for ease of manufacture, the lower base element 20 and the upper base element 30 are formed as separate components. However, the lower base element 20 and the upper base element 30 may be formed as a single unitary integral base structure for holding the first bottle 50 and the second bottle 60.

The lower base element 20 is arcuate and includes a side wall 23 that extends upward from a floor 24 and terminates at an upper outermost edge 29. The side wall 23 and the floor 24 create a mounting structure that holds the upper base element 30. Mounting posts 22*a* to 22*f* extend downward from the floor 24 of the lower base element 20 to support the dispensing plate 70 as described below. Extending upwardly from the floor 24 of the lower base element 20 is a first piercing post 25 comprising a cylindrical tubular section 42 that defines a feed conduit 43. An upper end of the tubular section 42 terminates obliquely to form an elliptical mouth. The floor 24 of the lower base element 20 includes a dispensing hole 44 within the area bounded by the tubular section 42 of the first piercing post 25. An upwardly extending projection 26 is also within the area bounded by the tubular section 42 of the first piercing post 25. Also extending upwardly from the floor 24 of the lower base element 20 is a second piercing post 27 comprising a cylindrical tubular section 47 that defines a second feed conduit 48. An upper end of the tubular section 47 terminates obliquely to form an elliptical mouth. The floor 24 of the lower base element 20 includes a second dispensing hole 49 within the area bounded by the tubular section 47 of the second piercing post 27. An upwardly extending projection 28 is also within the area bounded by the tubular section 47 of the second piercing post 27. The lower base element 20 is also formed with a series of drain slots 88 at the bottom of the rear side which allow the flushing water to drain away from above the dispensing plate 70.

The upper base element 30 is arcuate and is installed within the lower base element 20 when the dispensing device 10 is assembled. Typically, the lower base element 20 and the upper base element 30 are assembled by the manufacturer. (Optionally, the lower base element 20 and the upper base element 30 may be formed as a single unitary integral base structure as described above.) The upper base element 30 includes a side wall 37 that extends upwardly from a floor 38. The floor 38 of the upper base element 30 has a pair of access holes 39*a* and 39*b* through which the first piercing post 25 and the second piercing post 27 pass when the upper base element 30 is installed within the lower base element 20. The access holes 39*a* and 39*b* are surrounded by a plurality of upstanding tabs 36 whose function will be described below. The floor 38 of the upper base element 30 has a central raised section 32 with elongated narrow openings 33 on opposite sides of the central raised section 32.

The first bottle 50 is arcuate and includes a circular mouth 52 that is covered by a closure 54 that seals the liquid 58 in the first bottle 50 for shipment and storage. In the version of the first bottle shown in the FIG. 8, the closure 54 is a thermoplastic cap with a channel that engages a circular flange at the mouth 52 of the first bottle 50. Other closures, such as foil or plastic film, would also be suitable for sealing the mouth 52 of the first bottle 50. The central portion 55 of the closure 54 shown in FIG. 8 has a frangible seal with a circular area of reduced thickness. The second bottle 60 is also arcuate and includes a circular mouth 62 that is covered by a closure 64 that seals the liquid 68 in the second bottle 60 for shipment and storage. The closure 64 is a thermoplastic cap with a channel that engages a circular flange at the mouth 62 of the second bottle 60. Other closures, such as foil or plastic film, would also be suitable for sealing the mouth 62 of the second bottle 60. The central portion 65 of the closure 64 has a frangible seal with a circular area of reduced thickness.

During installation by a user, the inverted first bottle 50 is oriented over the first piercing post 25 such that the circular inner wall of the closure 54 approximately lines up with the circular outer surface of the first piercing post 25, and the first bottle 50 is moved in a downward direction until the upper end of the first piercing post 25 causes the circular area 55 of the frangible seal of the first bottle 50 to fracture. The feed conduit 43 of the first piercing post 25 is then placed in fluid communication with the mouth 52 of the first bottle 50 and the first liquid 58 may flow from the first bottle 50 through the feed conduit 43 and out of the dispensing hole 44 in the floor 24 of the lower base element 20 by way of gravity. By properly dimensioning the piercing post 25 and the closure 54 and the mouth 52 of the first bottle 50, a fluid tight seal is formed when the first bottle 50 is installed. The upwardly extending projection 26 serves to keep the circular area 55 of the frangible seal of the first bottle 50 from reclosing. The upstanding tabs 36 serve to secure the first bottle 50 in the device. The upstanding tabs 36 may grasp the neck of the first bottle 50 and/or the closure 54.

Also during installation by a user, the inverted second bottle 60 is oriented over the second piercing post 27 such that the circular inner wall of the closure 64 approximately lines up with the circular outer surface of the second piercing post 27, and the second bottle 60 is moved in a downward direction until the upper end of the second piercing post 27 causes the circular area 65 of the frangible seal of the second bottle 60 to fracture. The feed conduit 48 of the piercing post 27 is then placed in fluid communication with the mouth 62 of the second bottle 60 and the second liquid 68 may flow from the second bottle 60 through the feed conduit 48 and out of the dispensing hole 49 in the floor 24 of the lower base element 20 by way of gravity. By properly dimensioning the second piercing post 27 and the closure 64 and the mouth 62 of the second bottle 60, a fluid tight seal is formed when the second bottle 60 is installed. The upwardly extending projection 28 also serves to keep the circular area 65 of the frangible seal of the second bottle 60 from reclosing. The upstanding tabs 36 serve to secure the second bottle 60 in the device. The upstanding tabs 36 may grasp the neck of the second bottle 60 and/or the closure 64.

The liquid dispensing plate 70, which assists in distribution of the liquids 58 and 68 into the flush water, is supported by the lower base element 20. The dispensing plate 70 may be a separate component that is attached to the lower base element 20 or may be formed integral with the lower base element 20. In the version of dispensing device 70 shown in the drawings, the dispensing plate 70 is a separate component that is attached to the lower base element 20 by way of mounting holes 71*a* to 71*f* in the dispensing plate 70 and mounting posts 22*a* to 22*f* that extend downward from the floor 24 of the lower base element 20. The mounting posts 22*a* to 22*f* are press fit into the mounting holes 71*a* to 71*f* in the dispensing plate 70 to secure the dispensing plate 70 to the lower base element 20.

Figure 11A:
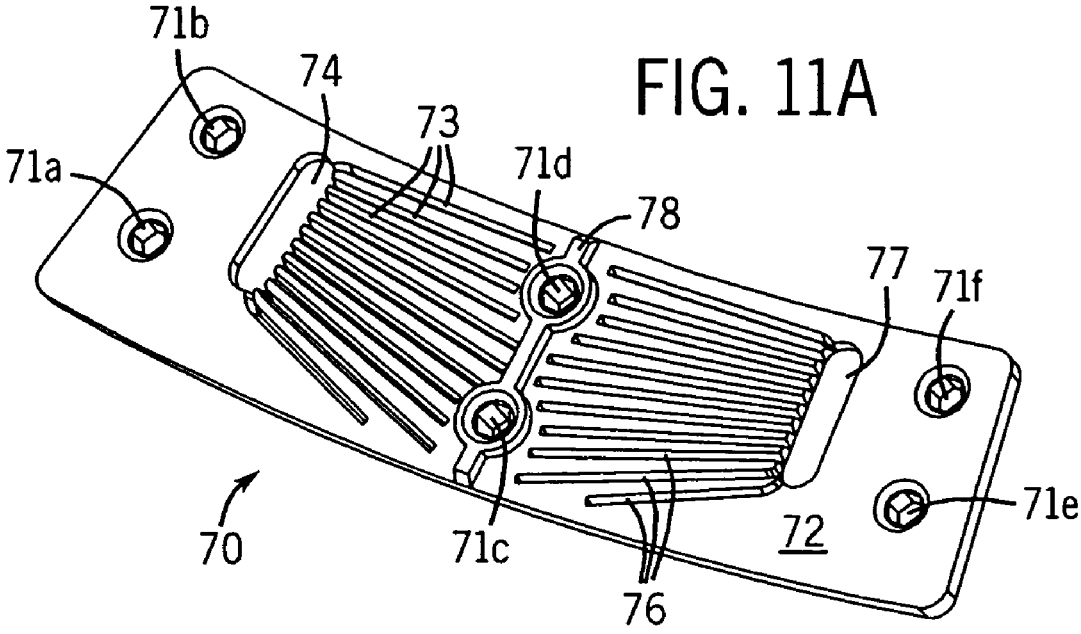
FIG. 11A is a front right perspective view from above of the dispensing plate of the liquid dispensing device of FIG. 1.
Figure 11B:
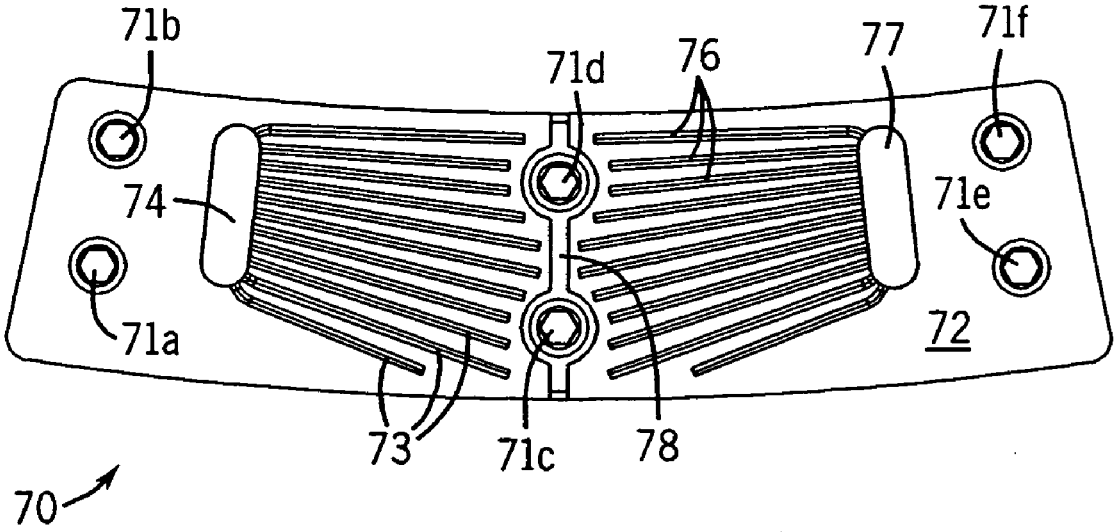
FIG. 11B is a top view of the dispensing plate of the liquid dispensing device of FIG. 1.

FIGS. 11A and 11B show the configuration of one version of the dispensing plate 70. The dispensing plate 70 has an upper surface 72 with a first group of capillary channels 73 that radiate out from a first collecting cavity 74 that is formed in the upper surface 72 at a position inwardly spaced from the edge of the dispensing plate 70. The capillary channels 73 may have a variety of transverse cross-sectional shapes, and preferably, the capillary channels 73 have a square, rectangular or triangular transverse cross-sectional shape. The depth of the capillary channels 73 may also be configured in a variety of fashions. The lower surface of the capillary channels 73 may be coplanar with the lower surface of the first collecting cavity 74 from the first collecting cavity 74 to an end of the capillary channels 73 such that the depth of the capillary channels 73 is substantially equal to the depth of the collecting cavity 74. The lower surface of the capillary channels 73 may also descend from the lower surface of the first collecting cavity 74 to the end of the capillary channels 73.

The upper surface 72 of the dispensing plate 70 also has a second group of capillary channels 76 that radiate out from a second collecting cavity 77 that is formed in the upper surface 72 at a position inwardly spaced from the edge of the dispensing plate 70. The capillary channels 76 may have a variety of transverse cross-sectional shapes as described above in relation to the first group of capillary channels 73. The depth of the capillary channels 76 may also be configured in the variety of fashions as described above in relation to the first group of capillary channels 73.

The dispensing plate 70 is attached to the lower base element 20 such that the first collecting cavity 74 of the dispensing plate 70 is placed in fluid communication with the dispensing hole 44 at the bottom of the first piercing post 25 to provide a fluid path between feed conduit 43 and the collecting cavity 74 of the dispensing plate 70. As a result of this configuration, liquid flows out of the first bottle 50, into the feed conduit 43, through the dispensing hole 44 and into the first collecting cavity 74 of the dispensing plate 70. Liquid then flows from the first collecting cavity 74 of the dispensing plate 70 into the capillary channels 73 in the upper surface 72 of the dispensing plate 70. The liquid then continues to move toward the end of the capillary channels 73 where the liquid is dispensed to the toilet as will be hereinafter described. Various means can be used to move the liquid from the collecting cavity 74 of the dispensing plate 70 into the capillary channels 73. First, the capillary action provided by adherence of the fluid to the sides of the capillary channels 73 serves to move the liquid toward the end of the capillary channels 73. Second, the capillary channels 73 may have a depth greater than the depth of the collecting cavity 74 that serves to move the liquid from the collecting cavity 74 and toward the end of the capillary channels 73.

Likewise, the dispensing plate 70 is attached to the lower base element 20 such that the second collecting cavity 77 of the dispensing plate 70 is placed in fluid communication with the dispensing hole 49 at the bottom of the second piercing post 27 to provide a fluid path between feed conduit 48 and the second collecting cavity 77 of the dispensing plate 70. As a result of this configuration, liquid flows out of the second bottle 60, into the feed conduit 48, through the dispensing hole 49 and into the second collecting cavity 77 of the dispensing plate 70. Liquid then flows from the second collecting cavity 77 of the dispensing plate 70 into the capillary channels 76 in the upper surface 72 of the dispensing plate 70. The liquid then continues to move toward the end of the capillary channels 76 where the liquid is dispensed to the toilet as will be hereinafter described. The means that can be used to move the liquid from the collecting cavity 77 of the dispensing plate 70 into the capillary channels 77 is described above. The dispensing plate 70 may have an upwardly extending wall 78 in a central region, positioned between the first group of channels 73 and the second group of channels 76. The wall 78 prevents the mixing of the first liquid 58 and the second liquid 68 on the dispensing plate 70.

Having described the means for moving liquid from the first bottle 50 and the second bottle 60 to the capillary channel dispensing positions on the upper surface 72 of the dispensing plate 70, the use of the liquid dispensing device 10 can be described by reference to FIGS. 12 and 13 which illustrate the configuration of the liquid dispensing device 10 when used with a toilet 16B with an open rim. With the liquid dispensing device 10 suspended from the rim of toilet 16B, flushing water W will contact the dispensing plate 70 with each flush. In particular, the first bottle 50 and the second bottle 60 are at least partially spaced apart to define a flush water flow path 85 between the first bottle 50 and the second bottle 60 (see FIGS. 6 and 13). Flush water can flow downward in the flush water flow path 85 and then downward through the elongated narrow openings 33 on opposite sides of the central raised section 32 of the upper base element 30. The flush water then flows through hole 90 in the floor 24 of the lower base element 20 and onto the dispensing plate 70. When the flushing water contacts the dispensing plate 70, the flush water mixes with the liquids 58 and 68 present in the capillary channels 73 and 76 on the upper surface 72 of the dispensing plate 70 and then the flush water portion with each of the liquids 58 and 68 is distributed into the toilet through an opening 82 in the front of the lower base element (see FIG. 3) and/or through the drain slots 88 at the bottom of the rear of the lower base element (see FIG. 4). Flush water may also enter through the opening 82 in the front of the lower base element 20 such that the flush water mixes with the liquids 58 and 68 present in the capillary channels 73 and 76 on the upper surface 72 of the dispensing plate 70 before entering the toilet bowl. After the flushing water washes the two liquids 58 and 68 from the dispensing positions of the dispensing plate 70 into the toilet water, a fresh supply of the two liquids is distributed from the first bottle 50 and the second bottle 60 to the capillary channels 73 and 77 as described above. The fresh supply of liquids 58 and 68 is then available for the next toilet flush.

The under the toilet rim two liquid dispensing device 10 has many advantages. For example, when the dispensing device 10 is installed on a toilet rim, a majority (i.e., greater than one half) of an upper surface of the first bottle and a majority (i.e., greater than one half) of an upper surface of the second bottle are not visible from above the rim of the toilet bowl when the dispensing device is installed on the rim of the toilet bowl. This results from the arcuate configuration of the first bottle 50 and the second bottle 60 and the lower base element 20. As shown in FIG. 13, the arcuate first bottle 50 and second bottle 60 have a shape that conforms to the toilet rim 16B. In other words, a side wall 51 of the first bottle 50 and a side wall 61 of the second bottle 60 define a convex plane opposite the suspension hook 40 when the first bottle 50 and the second bottle 60 are installed in the device 10. Thus, the dispensing device 10 has a discreet fit in the toilet. As a result, the toilet rim blocks much of the view of the dispensing device 10 as will be apparent from an analysis of FIG. 13. This discreet appearance appeals to many consumers.

Figure 1:
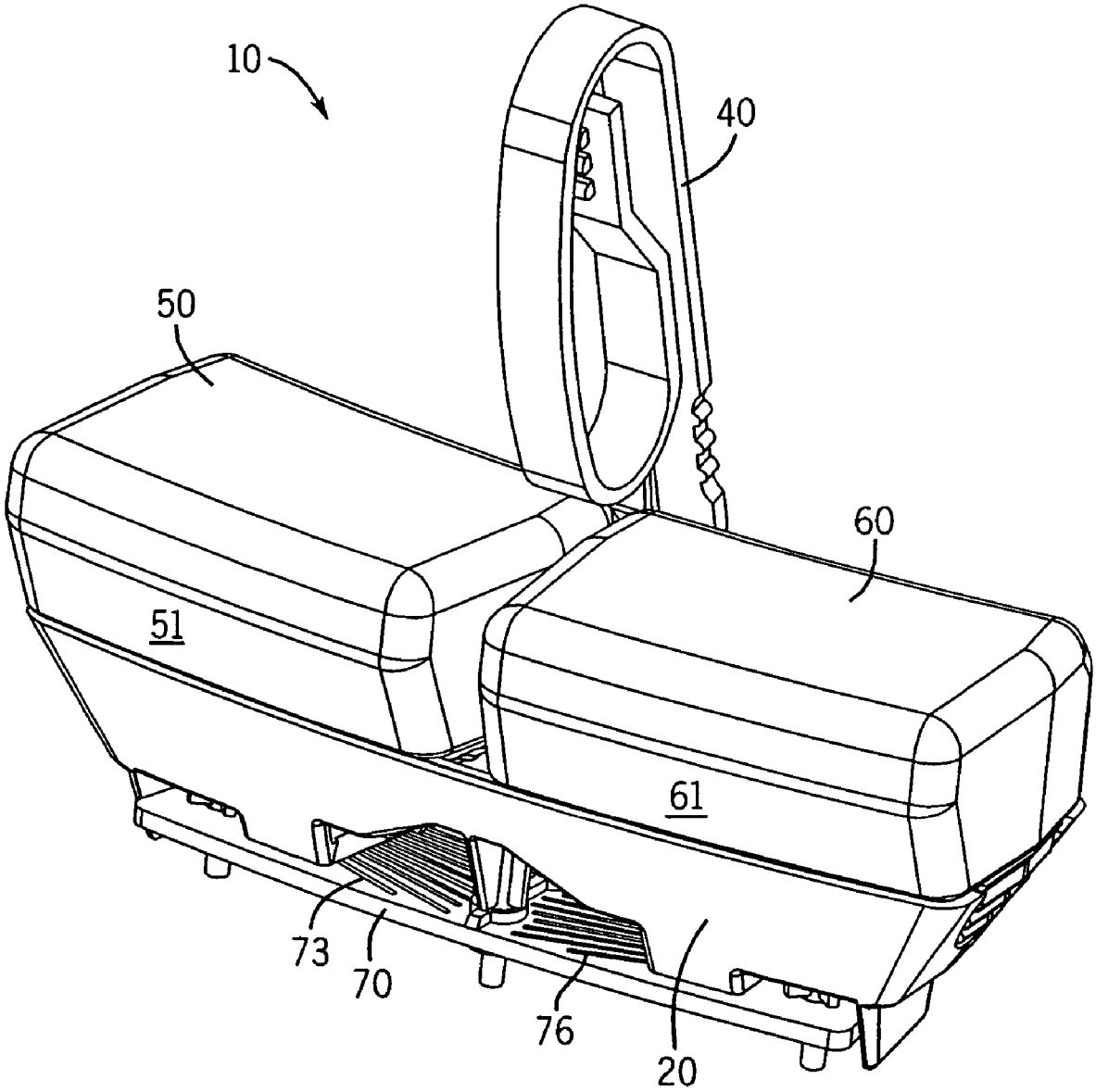
FIG. 1 is a front right perspective view of an under the toilet rim liquid dispensing device in accordance with the invention.
Figure 2A:
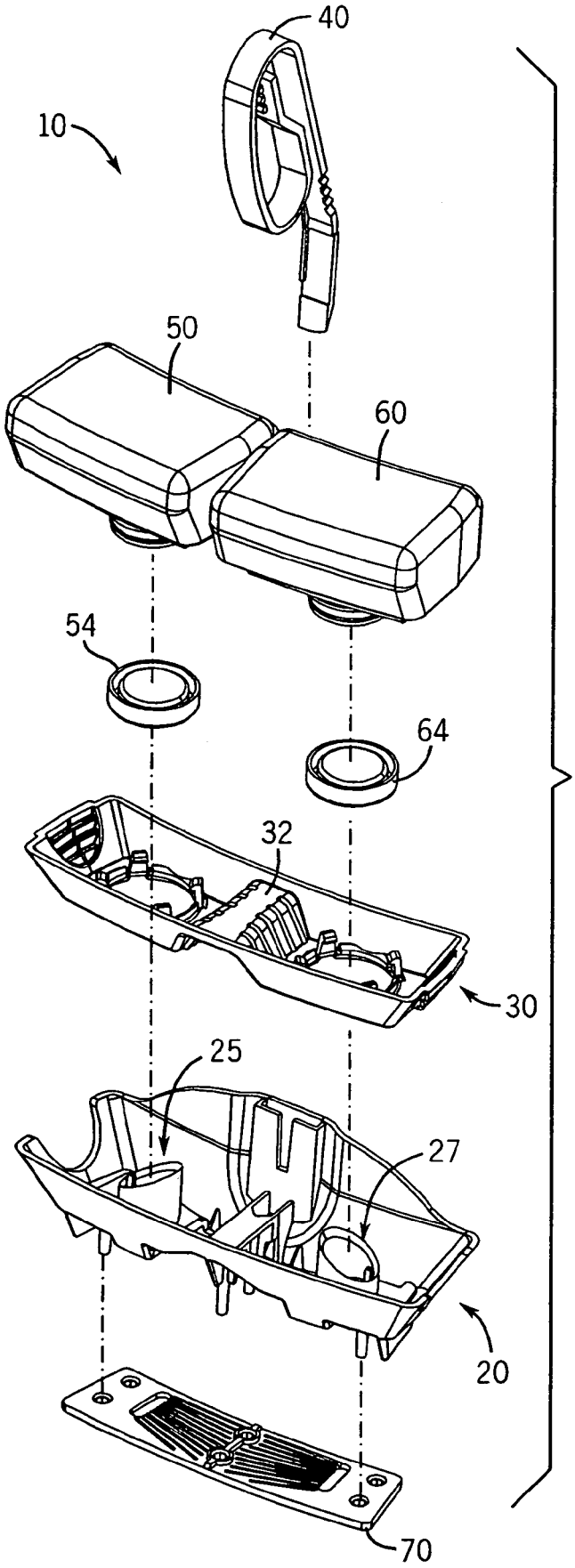
FIG. 2A is a front right exploded perspective view of the liquid dispensing device of FIG. 1.
Figure 2B:
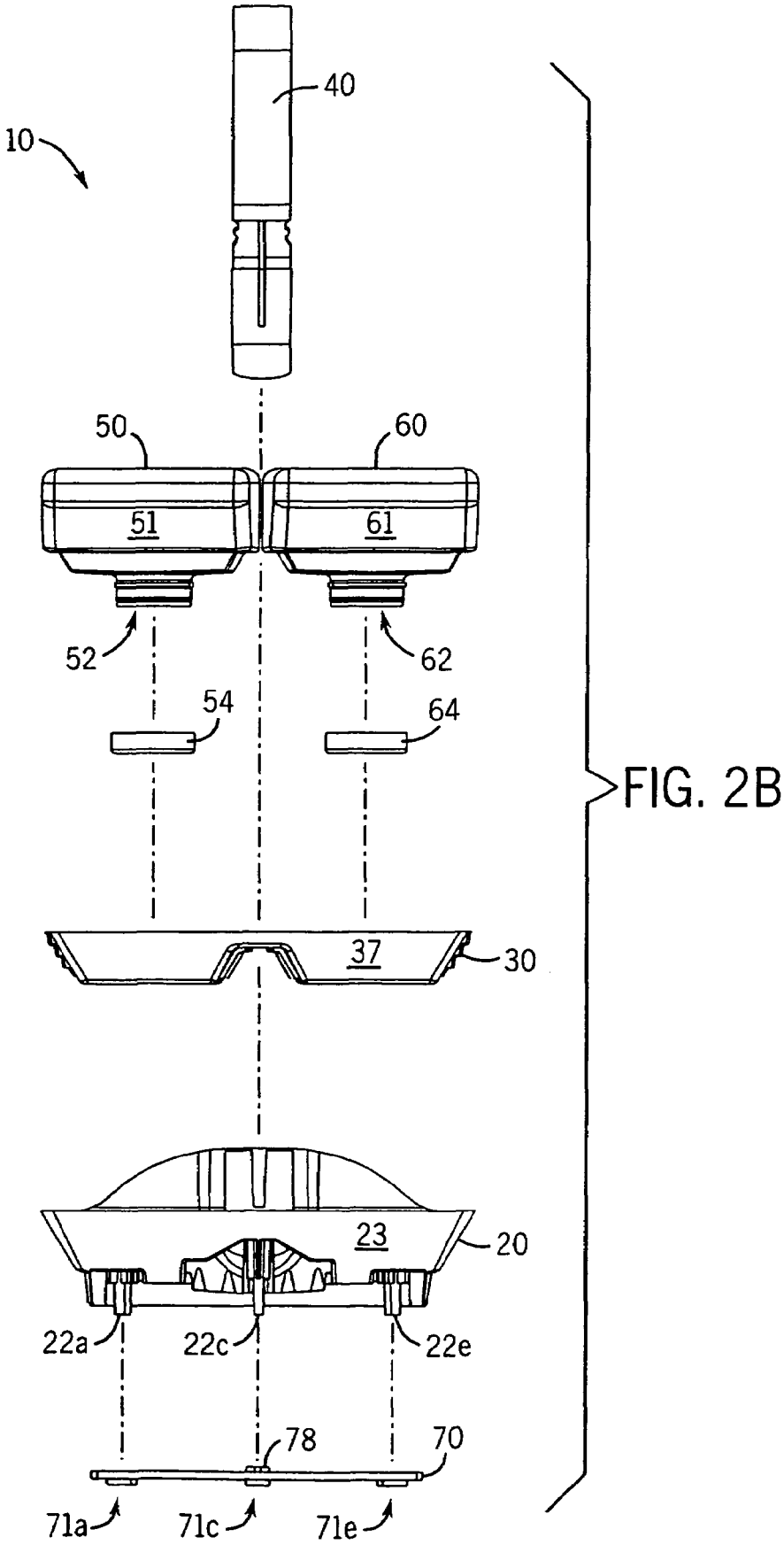
FIG. 2B is a front exploded view of the liquid dispensing device of FIG. 1.
Figure 2C:
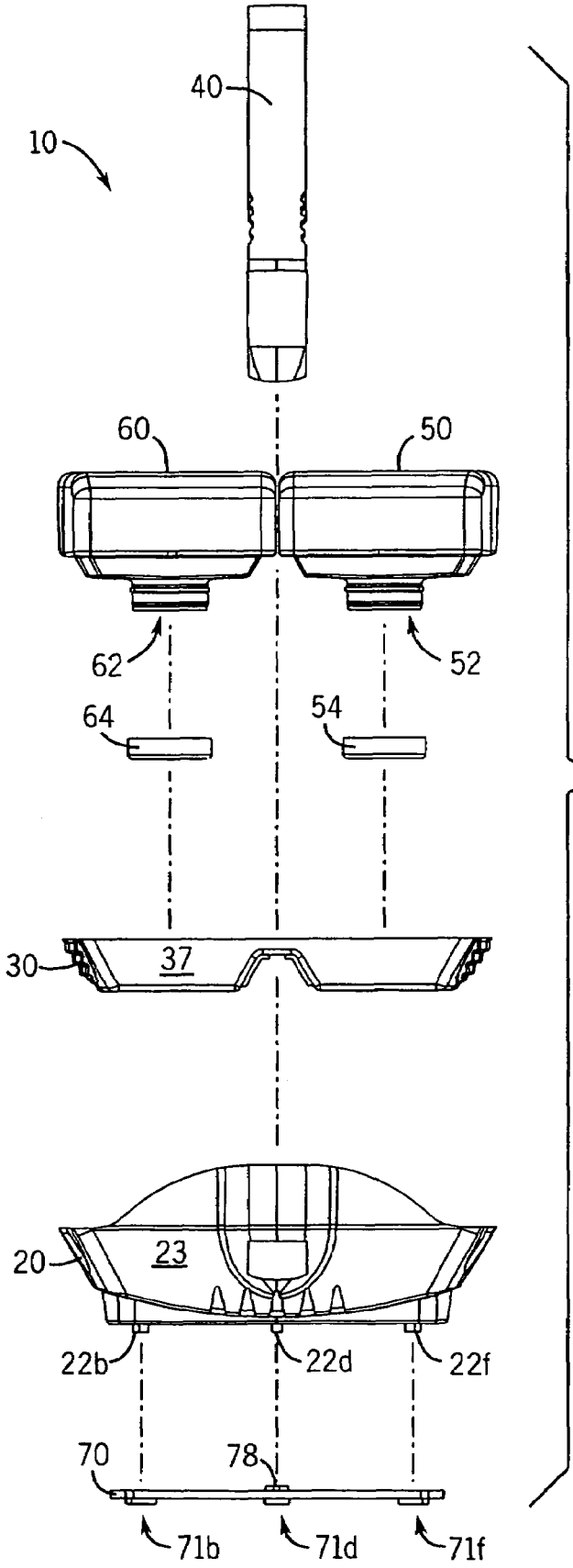
FIG. 2C is a rear exploded view of the liquid dispensing device of FIG. 1.
Figure 3:
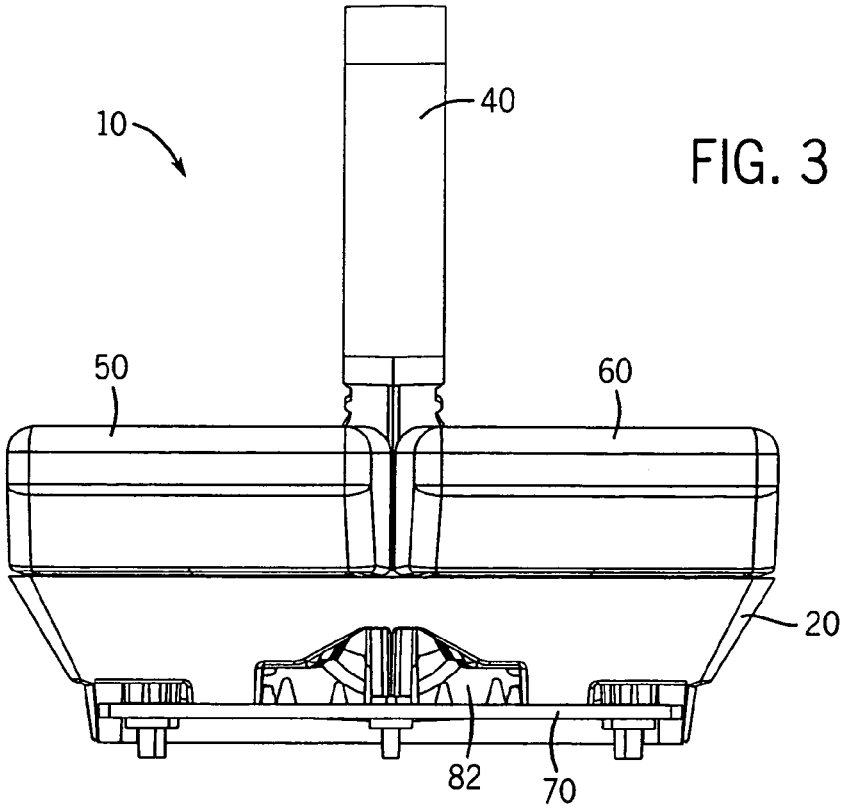
FIG. 3 is a front view of the liquid dispensing device of FIG. 1.
Figure 4:
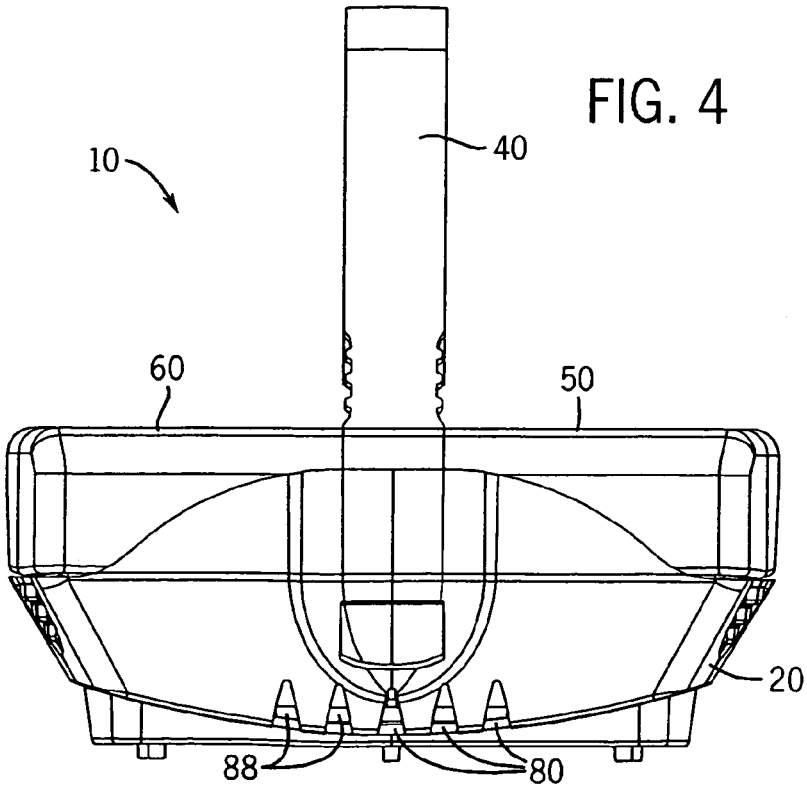
FIG. 4 is a rear view of the liquid dispensing device of FIG. 1.
Figure 5:
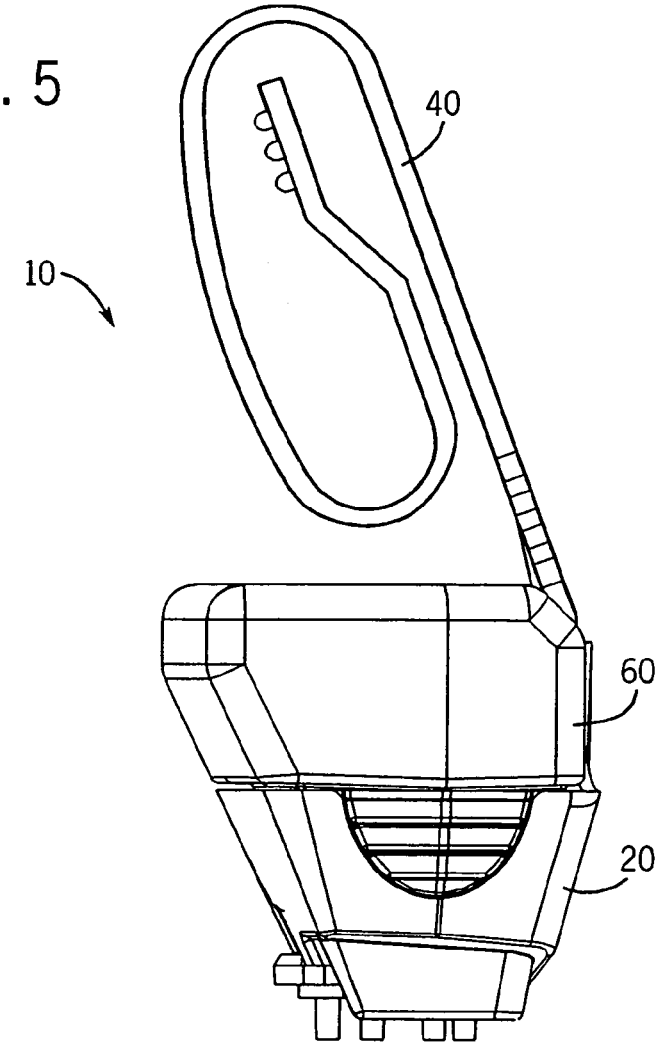
FIG. 5 is a right side view of the liquid dispensing device of FIG. 1, the left side view being a mirror image of the right side view.
Figure 6:
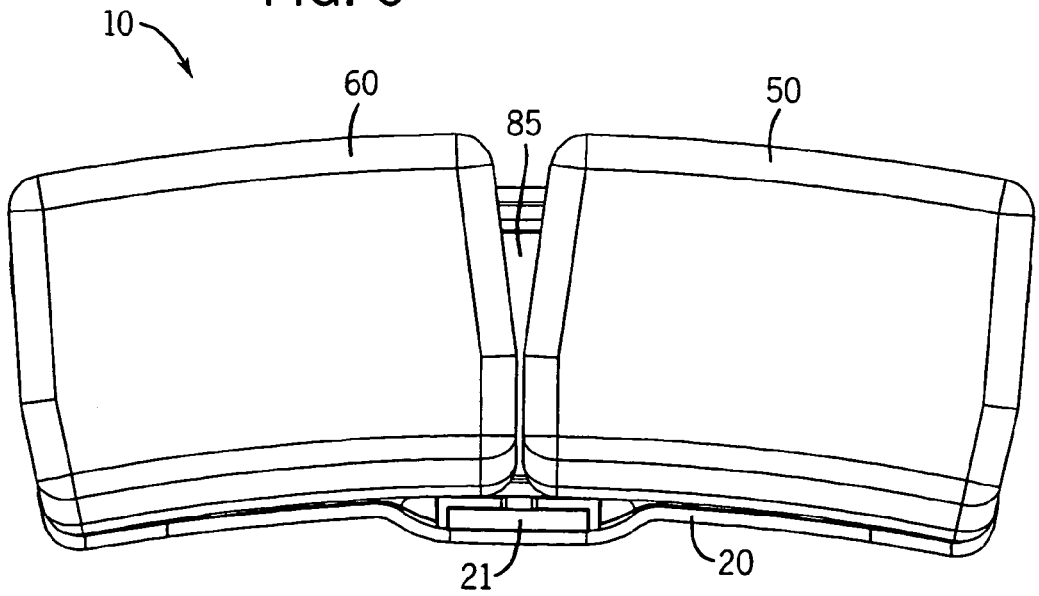
FIG. 6 is a top view of the liquid dispensing device of FIG. 1 with the suspension hook removed for clarity.
Figure 7:
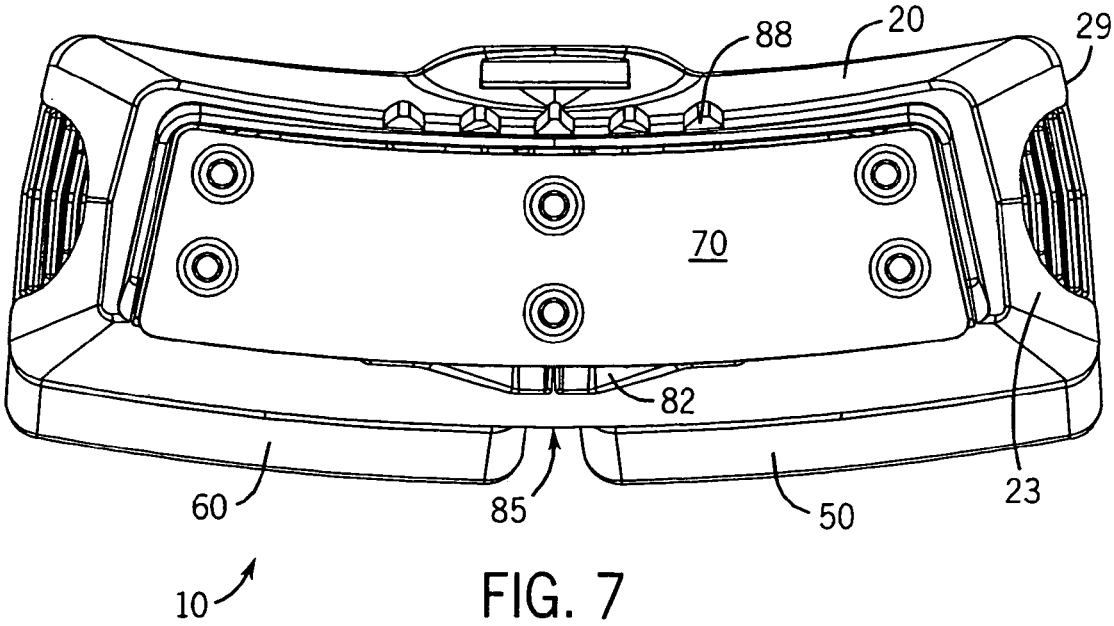
FIG. 7 is a bottom view of the liquid dispensing device of FIG. 1.
Figure 8:
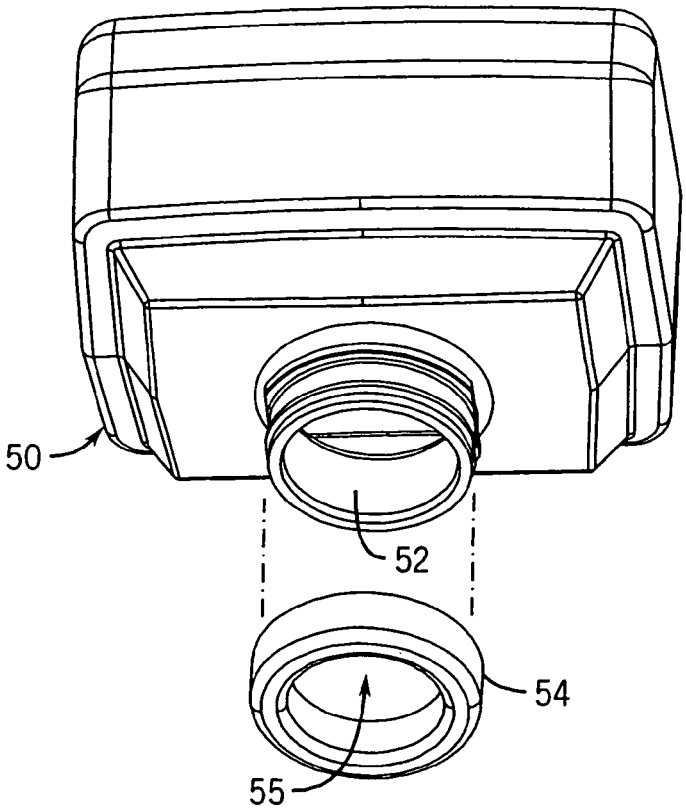
FIG. 8 is a front perspective view of the bottle and bottle closure of the liquid dispensing device of FIG. 1.

The discreet fit is also the result of configuring the dispensing plate 70 such that the dispensing plate 70 does not extend outward beyond the outermost edge 29 of the lower base element 20 (see FIG. 7). If the dispensing plate 70 were to stick out beyond the lower base element 20, the bottles of the dispensing device 10 could not be positioned close to the inner wall of the toilet bowl because the dispensing plate 70 would contact the inner wall of the toilet bowl and create a spacing between the lower base element 20 and the toilet bowl.

The discreet fit is also possible because the first bottle 50 and the second bottle 60 are at least partially spaced apart to define a flush water flow path 85 between the first bottle 50 and the second bottle 60 (see FIG. 13). Flush water can flow downward in the flush water flow path 85 through the base elements 20 and 30 and onto the dispensing plate 70, or through the opening 82 in the front of the lower base element and onto the dispensing plate 70. Thus, clearance is not necessarily required between the first bottle 50 and the second bottle 60 and the inner wall of the toilet bowl for a flush water flow path.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention may be used for dispensing liquids, such as cleaning and freshening liquids, from under the rim of a toilet bowl by way of the flow of water during a toilet flush.

What is claimed is:

1. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein a majority of an upper surface of the first bottle and a majority of an upper surface of the second bottle are not visible from above the rim of the toilet bowl when the dispensing device is installed on the rim of the toilet bowl, wherein the wicking device comprises a dispensing plate having channels formed in an upper surface of the dispensing plate, the channels including a first group of channels extending inward from a position below the mouth of the first bottle toward a central region of the dispensing plate and a second group of channels extending inward from a position below the mouth of the second bottle toward the central region of the dispensing plate.

2. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein the wicking device does not extend outward beyond an outermost edge of the base.

3. The dispensing device of claim 2 wherein:

the wicking device comprises a dispensing plate having channels formed in an upper surface of the dispensing plate, the channels including a first group of channels extending inward from a position below the mouth of the first bottle and a second group of channels extending inward from a position below the mouth of the second bottle.

4. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein the first bottle and the second bottle are at least partially spaced apart to define a flush water flow path between the first bottle and the second bottle and through openings in the base.

5. The dispensing device of claim 4 wherein:

the wicking device comprises a dispensing plate having channels formed in an upper surface of the dispensing plate, the channels including a first group of channels extending inward from a position below the mouth of the first bottle and a second group of channels extending inward from a position below the mouth of the second bottle.

6. The dispensing device of claim 4 wherein:

the openings in the base direct flush water onto an upper surface of the wicking device.

7. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein the wicking device comprises a dispensing plate having channels formed in an upper surface of the dispensing plate, the channels including a first group of channels extending inward from a position below the mouth of the first bottle toward a central region of the dispensing plate and a second group of channels extending inward from a position below the mouth of the second bottle toward the central region of the dispensing plate.

8. The dispensing device of claim 7 wherein:

the dispensing plate has an upwardly extending wall positioned between the first group of channels and the second group of channels.

9. The dispensing device of claim 7 wherein:

the first group of channels extends inward from a first collecting cavity at the position below the mouth of the first bottle and the second group of channels extends inward from a second collecting cavity at the position below the mouth of the second bottle.

10. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein the first bottle and the second bottle are arcuate, wherein the wicking device comprises a dispensing plate having channels formed in an upper surface of the dispensing plate, the channels including a first group of channels extending inward from a position below the mouth of the first bottle toward a central region of the dispensing plate and a second group of channels extending inward from a position below the mouth of the second bottle toward the central region of the dispensing plate.

11. The dispensing device of claim 10 wherein:

wherein a side wall of the first bottle and a side wall of the second bottle define a convex plane opposite the suspension means when the first bottle and the second bottle are installed in the base.

12. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein the base is arcuate, wherein the wicking device comprises a dispensing plate having channels formed in an upper surface of the dispensing plate, the channels including a first group of channels extending inward from a position below the mouth of the first bottle toward a central region of the dispensing plate and a second group of channels extending inward from a position below the mouth of the second bottle toward the central region of the dispensing plate.

13. A dispensing device for using flush water during a toilet flush to dispense liquids into a toilet bowl, the device comprising:

a first bottle for holding a first liquid, the first bottle having a mouth and a closure for covering the mouth;

a second bottle for holding a second liquid, the second bottle having a mouth and a closure for covering the mouth;

a base for holding the first bottle and the second bottle, the base having a first piercing post and a second piercing post, the first piercing post being suitable for opening the closure of the first bottle and the second piercing post being suitable for opening the closure of the second bottle;

a wicking device supported by the base, the wicking device being suitable to convey the liquid from the first bottle to a first dispensing position contacted with flush water during a toilet flush, and the wicking device being suitable to convey the liquid from the second bottle to a second dispensing position contacted with flush water during a toilet flush; and suspension means for suspending the base from a rim of the toilet bowl, wherein the base includes a plurality of upstanding tabs for securing the first bottle and the second bottle in the base.

14. The dispensing device of claim 13 wherein:

the wicking device comprises a dispensing plate having channels formed in an upper surface of the dispensing plate, the channels including a first group of channels extending inward from a position below the mouth of the first bottle and a second group of channels extending inward from a position below the mouth of the second bottle.

* * * * *